US006864824B2

(12) United States Patent
Garon et al.

(10) Patent No.: US 6,864,824 B2
(45) Date of Patent: Mar. 8, 2005

(54) ELECTROMAGNETIC REFLECTOR

(75) Inventors: Lionel Garon, Toulouse (FR); Alain Quillot, Lacaugne (FR)

(73) Assignee: Etienne Lacroix Tous Artifices S.A., Muret (FR)

( * ) Notice: Subject to any disclaimer, the term of this patent is extended or adjusted under 35 U.S.C. 154(b) by 0 days.

(21) Appl. No.: 10/346,949

(22) Filed: Jan. 17, 2003

(65) Prior Publication Data

US 2003/0137441 A1 Jul. 24, 2003

(30) Foreign Application Priority Data

Jan. 18, 2002 (FR) ..... 02 00602

(51) Int. Cl.[7] ..... H01Q 15/20; H01Q 15/18

(52) U.S. Cl. ..... 342/8; 342/5; 342/7; 342/10; 343/907; 343/912; 343/915

(58) Field of Search ..... 343/907–916; 342/1–12

(56) References Cited

U.S. PATENT DOCUMENTS

| | | | | | |
|---|---|---|---|---|---|
| 2,463,517 | A | * | 3/1949 | Chromak | 342/8 |
| 2,778,010 | A | * | 1/1957 | Leonard | 342/8 |
| 2,885,670 | A | * | 5/1959 | Kirgan | 342/8 |
| 2,912,687 | A | * | 11/1959 | Leonard | 342/8 |
| 3,015,095 | A | * | 12/1961 | Petri | 342/8 |
| 3,152,329 | A | * | 10/1964 | Lowery et al. | 342/8 |
| 3,451,060 | A | * | 6/1969 | Edwards | 342/8 |
| 3,568,191 | A | * | 3/1971 | Hiester et al. | 342/8 |
| 3,671,965 | A | | 6/1972 | Rabenhorst et al. | |
| 4,119,965 | A | * | 10/1978 | Kaszyk | 342/8 |
| 4,740,056 | A | * | 4/1988 | Bennett | 342/8 |
| 4,901,081 | A | * | 2/1990 | Bain et al. | 342/8 |
| 5,345,238 | A | | 9/1994 | Eldridge et al. | |
| 6,300,893 | B1 | | 10/2001 | Schaff et al. | |

FOREIGN PATENT DOCUMENTS

| | | |
|---|---|---|
| EP | 0838877 A2 | 4/1998 |
| EP | 1168498 A2 | 5/2001 |
| WO | WO 01/80362 A2 | 10/2001 |

* cited by examiner

*Primary Examiner*—Bernarr E. Gregory
(74) *Attorney, Agent, or Firm*—Blakely Sokoloff Taylor & Zafman

(57) ABSTRACT

The present invention provides an electromagnetic reflector comprising a deployable support frame carrying at least one sheet element designed to form a reflective surface when in the deployed state, wherein the support frame comprises a band that is suitable for being packaged in a folded state and that is suitable for returning to a deployed state in the absence of external constraint, the band being in the form of three rings that are orthogonal in pairs, and the reflector further comprising eight generally triangular panels of sheet material.

7 Claims, 1 Drawing Sheet

ELECTROMAGNETIC REFLECTOR

The present invention relates to the field of electromagnetic reflectors.

It relates to all potential applications of electromagnetic reflectors, such as, in non-limiting manner: use in the form of a position-locating beacon, e.g. for motor vehicles.

BACKGROUND OF THE INVENTION

Numerous means have already been proposed for forming electromagnetic reflectors.

Reference can be made, for example, to the following documents: FR-A-2 723 263, EP-0 182 274, FR-1 226 263, GB-0 913 547, U.S. Pat. No. 3,217,325, U.S. Pat. No. 3,041,604, U.S. Pat. No. 3,115,631, U.S. Pat. No. 3,568,191, GB-2 188 783, GB-2 189 079, FR-2 073 370, U.S. Pat. No. 4,119,965, U.S. Pat. No. 4,096,479, U.S. Pat. No. 4,072,948, U.S. Pat. No. 3,660,843, U.S. Pat. No. 3,276,017, GB-0 746 300, U.S. Pat. No. 3,296,617, EP-0 807 991, U.S. Pat. No. 3,618,111, EP-1 052 725, and GB-0 812 376.

OBJECT AND SUMMARY OF THE INVENTION

The present invention now has the object of proposing novel means making it possible to implement an electromagnetic reflector that presents good efficiency and that is simultaneously simple, reliable, and of low cost.

In the context of the present invention, this object is achieved by an electromagnetic reflector comprising a deployable support frame carrying at least one sheet element designed to form a reflective surface when in the deployed state, wherein the support frame comprises a band that is suitable for being packaged in a folded state and that is suitable for returning to a deployed state in the absence of external constraint, the band being in the form of three rings that are orthogonal in pairs, and the reflector further comprising eight generally triangular panels of sheet material.

Preferably, in the context of the invention, the band is made of a material having shape memory. It can be a material presenting intrinsic elasticity or a material having shape memory in which its crystal structure can be modified by a change in temperature.

BRIEF DESCRIPTION OF THE DRAWING

Other characteristics, objects, and advantages of the invention appear on reading the following detailed description of non-limiting examples given with reference to the accompanying drawing, in which.

MORE DETAILED DESCRIPTION

As mentioned above, the electromagnetic reflector in accordance with the present invention comprises in combination a deployable support frame 10 and a sheet element 20.

The description begins with a variant in accordance with the present invention in which the deployable support frame 10 is made of a material that presents intrinsic elasticity.

Figure 1:
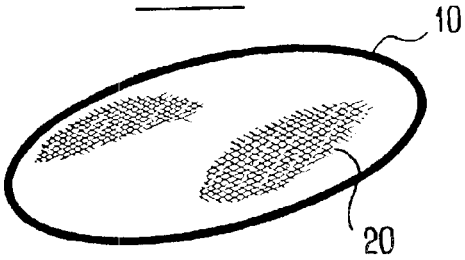
FIG. 1 is a diagrammatic perspective view of an electromagnetic reflector constituting a basic first variant embodiment in accordance with the present invention.
Figure 2:
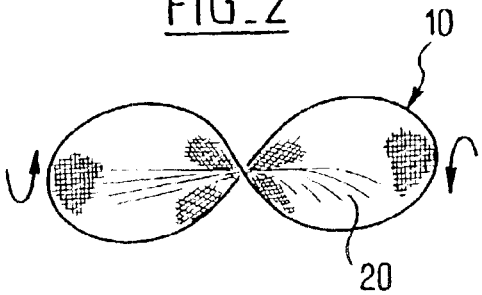
FIGS. 2 and 3 show two successive steps in the folding of this structure.
Figure 3:
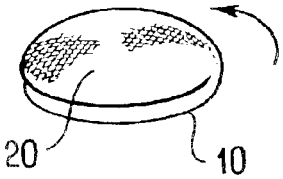
Figure 4:
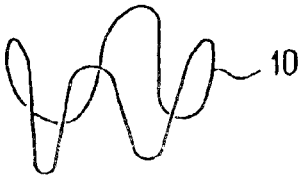
FIG. 4 shows an alternative way of folding the structure shown in FIG. 1.
Figure 5:
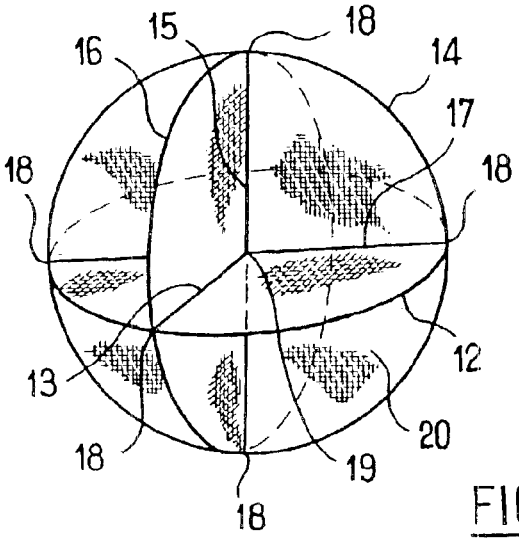
FIG. 5 is a perspective view of another variant embodiment in accordance with the present invention.
Figure 6:
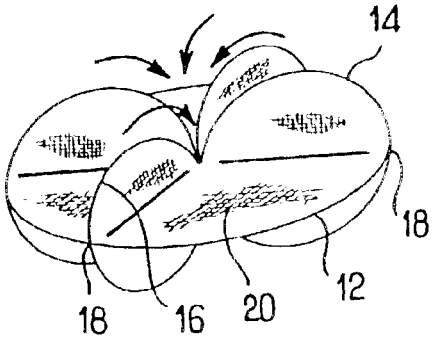
FIGS. 6 and 7 are two successive views of stages in the folding of such a structure.
Figure 7:
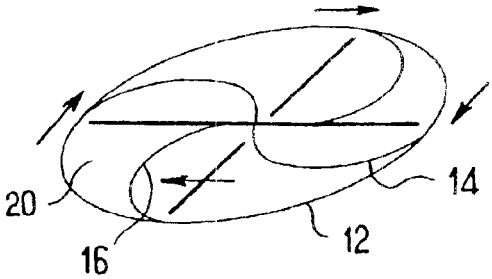

The deployable support frame 10 can be packaged in a folded state as shown for example in FIGS. 2 to 4 and in FIGS. 6 or 7, while remaining capable, in the absence of external constraint and because of its intrinsic elasticity, of returning spontaneously to a deployed state, as shown in FIGS. 1 and 5, for example.

This support frame 10 may be made of any suitable appropriate material. It is advantageously made of an elastic material.

By way of a non-limiting example, the support frame 10 can be made on the basis of an elastomer, of plastics materials, in particular of thermoplastic materials, and/or of metal.

Where appropriate, the support frame 10 can be of a composite material, for example a combination of elastomer and of metal. By way of non-limiting example, the support frame 10 can be made of an elastomer-coated metal core.

The support frame 10 can be implemented in a wide variety of shapes.

It can be constituted by a simple ring as shown in FIGS. 1 to 4.

Nevertheless, the support frame 10 can be constituted by a structure that is more complex. Thus, as shown in FIGS. 5 to 7, the support structure can comprise a combination of three rings 12, 14, 16 that are disposed orthogonally in pairs. These three rings 12, 14, and 16 thus lie in three mutually orthogonal planes like an orthonormal frame of reference.

The three rings 12, 14, and 16 are connected together at their connection points, which are referenced 18. The connection can be made in any suitable manner.

The person skilled in the art will understand that the structure based on three rings 5 to 7 serves to define an octahedron, i.e. a structure combining eight elements each in the form of a corner of a cube.

For this purpose, the structure shown in FIGS. 5 to 7 comprises eight generally triangular sheet elements 20 whose external edges coincide generally with the segments of the rings 12, 14, and 16 that are situated between pairs of connection points 18, and whose internal edges coincide with the three axes 13, 15, and 17 that are mutually orthogonal in pairs, passing via the center 19 of the structure and via the connection points 18.

In contrast, in the basic embodiment shown in FIG. 1, there is only a single sheet element 20 whose periphery is connected to the ring 10.

The sheet or the various sheet elements 20 may be connected to the support frame 10 by any appropriate means.

These means are preferably adapted to guarantee that each of the sheet elements 20 is plane.

The dimensions of the device of the present invention may vary widely depending on the intended application.

The sheet 20 may be made of any suitable appropriate material.

Preferably, it is constituted by metallized cloth.

Reference can usefully be made to document FR 01/02483 for how to make the sheet 20.

In storage, the electromagnetic reflector of the present invention is packed in the folded state as shown by way of non-limiting example in FIGS. 3, 4, or 7. The reflector can thus be packaged in any appropriate container.

On being released from the above-mentioned container, it returns spontaneously to its deployed position as shown in FIGS. 1 and 5.

A first non-limiting process for folding the basic structure shown in FIG. 1 consists in twisting the ring 10 into an 8-shape as shown in FIG. 2, and then in folding the two loops into which the ring 10 has been twisted one onto the other as shown in FIG. 3.

Once the device is released, it deploys in the reverse sequence.

An alternative second process for folding this single-ring structure 10 consists in shaping the ring 10 into a sinewave as shown in FIG. 4. Once this shape has been obtained, the size of the device can be further reduced by compressing the structure towards the center.

In this case also, deployment takes place in the reverse sequence.

A non-limiting implementation for folding the octahedron type structure shown in FIG. 5 is described below. Initially, as shown in FIG. 6, two diametrically opposite vertices 18 can be moved towards the center of the structure. This provides a basic disk carrying respective sets of four generally semicircular petals on each of its two opposite faces. These petals can then be folded flat onto the basic disk as shown in FIG. 7. This produces a structure comparable to that shown in FIG. 1 and which can then be subjected to the same folding procedures as described above, in particular with reference to FIGS. 2 to 4.

The person skilled in the art will understand that the present invention makes it possible to obtain an electromagnetic reflector presenting a surface area in the deployed state that is large, but a volume in the folded state that is small. Such a device can be made ready for use by means of any appropriate vector.

Naturally, the present invention is not limited to the particular embodiment described above, but extends to any variant within the spirit of the invention.

In particular, the present invention is not limited to being implemented as an octahedron, but extends to any polyhedral design.

Furthermore, and as mentioned above, the present invention is not limited to using a material that presents intrinsic elasticity. The invention extends to any equivalent means, and in particular to material having shape memory in which the crystal structure of the material can be modified by a change in temperature. Under such circumstances, it suffices to apply appropriate heating in order to deploy the reflector.

What is claimed is:

1. An electromagnetic reflector comprising a deployable support frame carrying at least one reflective sheet element, wherein the support frame is suitable for being folded and is suitable for returning to a deployed state in the absence of external constraint, the support frame being in the form of three rings that are orthogonal in pairs, so that the three rings lie in three mutually orthogonal planes and are connected together at their connection points, and the reflector further comprising panels of reflective sheet material whose external edges coincide with the segments of the rings that are situated between pairs of connection points and whose internal edges coincide with the three axes that are mutually orthogonal in pairs passing via the center of the structure and via the connection points.

2. A reflector according to claim 1, wherein the support frame is made of an elastic material.

3. A reflector according to claim 1, wherein the support frame is made of a material having shape memory with crystal structure that is modified by a change in temperature.

4. A reflector according to claim 1, wherein the support frame is made of a material selected from the group comprising: elastomers; plastics materials; and metals.

5. A reflector according to claim 1, wherein the support frame is made of a composite material.

6. A reflector according to claim 1, wherein the support frame comprises a single ring.

7. A reflector according to claim 1, wherein the sheet is based on a metallized textile fabric.

* * * * *